United States Patent [19]

Gallagher et al.

[11] Patent Number: 4,662,845

[45] Date of Patent: May 5, 1987

[54] TARGET SYSTEM FOR LASER MARKSMANSHIP TRAINING DEVICES

[75] Inventors: Lawrence J. Gallagher, Arcadia; Bharat V. Chudasama, Pasadena, both of Calif.

[73] Assignee: Loral Electro-Optical Systems, Inc., Pasadena, Calif.

[21] Appl. No.: 781,233

[22] Filed: Sep. 27, 1985

[51] Int. Cl.[4] ..... F41J 5/02

[52] U.S. Cl. ..... 434/22; 273/372

[58] Field of Search ..... 434/22; 273/371, 372, 273/378, 386

[56] References Cited

U.S. PATENT DOCUMENTS

| | | | |
|---|---|---|---|
| 2,939,706 | 6/1960 | Skaredoff | 273/372 |
| 4,261,579 | 4/1981 | Bowyer et al. | 273/372 |
| 4,351,026 | 9/1982 | Phillips | 273/372 |

*Primary Examiner*—Leo P. Picard

*Attorney, Agent, or Firm*—Spensley Horn Jubas & Lubitz

[57] ABSTRACT

A target system for laser marksmanship training devices is comprised of one or more photodetectors mounted on a target and sensitive to one or more pulses of the operating wavelength of a laser beam simulating the projectile of a weapon. An amplifier increases the power output of the photodetectors, and a frequency selective transducer is operated from the amplified output of the photodetectors. The transducer is attached and acoustically coupled to the target and produces a vibration signature simulating the vibration characteristics of a weapon-fired projectile striking the target. A microphone sensitive to the vibration signature of the transducer is acoustically coupled to the target, and a drive mechanism lowers the target out of the field of view of the weapon when the microphone receives a hit-indicating vibration signature from the transducer.

In a preferred embodiment the laser pulses include a code sequence identification of the weapon being fired and the amplifier includes a decoder for the pulse code sequence. The decoder includes a dual signal threshold level comparator in which a pulse signal level exceeding the first threshold level is established for a man target, and a pulse signal level exceeding the second threshold level is established for a vehicle target whereby the transducer is energized to initiate lowering of the target.

20 Claims, 2 Drawing Figures

TARGET SYSTEM FOR LASER MARKSMANSHIP TRAINING DEVICES

BACKGROUND OF THE INVENTION

Marksmanship training using lasers instead of projectiles has been widely used in recent years, for reasons of both economy and safety. For instance, a machine gun capable of firing a thousand rounds of ammunition a minute can consume many thousands of dollars in ammunition in a single day of training, and also can represent a considerable hazard in the hands of an inexperienced trainee. There are similar cost and safety considerations in training personnel to fire artillery rounds like tank main-gun rounds that cost fifteen hundred dollars each, or air-to-ground, ground-to-ground, and ground-to-air missiles costing up to twenty thousand dollars each. It is necessary to train personnel to operate such weapons without actually shooting down simulated aircraft, such as drones or towed targets, or shooting relatively expensive tank targets. Therefore some sophisticated systems for simulating the lethality, accuracy, effective range, appearance, and even the sound of such weapons have been developed and are presently in use. These systems employ laser beams to replicate projectiles and pyrotechnic devices to simulate the actual weapons' audio-visual signatures.

These laser training systems are based on a microprocessor controlled laser transmitters coupled with inexpensive multiple sensor detection systems. The laser transmitters are mounted on the weapons they are simulating, and the detection systems are mounted on targets.

The laser transmitter transmits pulse coded messages which contain both "hit" and "near miss" information. Near misses occur when the shooter aims and fires close, but not in the lethal zone of a target, thus cueing the target that he has been located, nearly killed and that evasive maneuvers are required if he is to survive the encounter. This pulse coded laser also facilitates the preservation of weapon hierarchy, i.e., an M16 rifle can kill men, not tanks. Tanks can kill almost anything.

Another important aspect of laser simulation techniques is the tailoring of the transmitter and detection system to accurately portray the range, probability of kill and lethality zones of simulated systems. This is accomplished by controlling the type of laser, laser coding, and detector placement on the target.

The resulting training obtained is valuable in a tactical sense, but is not practical for training in the fundamentals of aiming and firing weapons. Range targets have evolved to be responsive to record the hits of actual ammunition, and presently exist in large numbers and in many forms that represent soldiers, vehicles and tanks. These targets sense being hit by a projectile with a vibration sensor that detects the impact noise signature that is propagated through the target structure. When the target is literally hit, a mechanism lowers the target out of the line of fire, indicating a hit to the shooter.

Many companies manufacture such targets as standardized military hardware. Nearly all of them use frequency selective vibration sensing transducers to record physical hit and actuate various responses, including target drop, smoke release, or erecting other targets. Nearly every military installation and many civilian gun ranges have many of this type of target.

There are several distinct disadvantages in such range operations. The hazard in firing live ammunition is present, and range accidents are not unusual. Live ammunition is also injurious to the targets, requiring patching to obscure past hits and permit scoring current hits, and also requiring structural repairs after repeated use. Another severe problem is that the target ranges for live ammunition firing take up a great deal of land. For instance, a tank round can travel 40 kilometers. This would require the range to have a 25 mile radius about the firing point, making the range 50 miles across.

SUMMARY OF THE INVENTION

A primary purpose of the present invention is to provide a target system to permit laser gunnery training on existing livefire target ranges by providing an optical-to-acoustical interface; coupling a weapon-simulating laser beam to the projectile-hit signature sensing frequency selective vibration sensor transducer of a conventional and commercially available target mechanism.

It is a further purpose of the invention to provide a laser coding and target decoding system whereby a target hit from a specific weapon may be identified.

It is yet a further purpose of the invention to provide a laser coding system in which various levels of weapons lethality may be used, and the target decoding system can discriminate weapons lethality and accept hit or near miss information only from weapons having a specified minimum lethality level that is appropriate for the type of target used.

The achievement of the foregoing purposes of the present invention is accomplished through the use of a laser mounted on a weapon and firing a coded pulse of optical energy to simulate the firing of a projectile at a target. The target is provided with a frequency selective vibration sensor transducer to detect a physical hit by a fired projectile from a live-ammunition weapon, and has a lift mechanism that drops the target from view when a hit is sensed by the frequency selective vibration sensor transducer. A number of photodectors are attached to the target in a number of optional arrangements suitable for the size and shape of a selected target profile.

The coded pulse of optical energy from the laser striking one or more of the photodetectors is decoded and compared to suitable threshold levels to qualify as a hit, and compared to a code format to determine if the weapon lethality is sufficient for the target. Upon qualification of a hit, an amplified signal is sent to a frequency selective driving transducer that is acoustically coupled to the target, sending an appropriate projectile hit acoustic signature to the frequency selective vibration sensor transducer through mechanical vibrations through the target, without the use of wires. The frequency selective vibration sensor transducer output is amplified and initiates dropping of the target by a lift mechanism.

Targets including a frequency selective vibration sensor transducer and lift mechanism are commonly used for firearms training using live ammunition. The transducer senses the vibration signature propagated through the target structure as a projectile strikes the target, initiating the operation of the lift mehcanism to drop the target. The present invention does not require any modification of these commercially available targets, but interfaces with them to convert live-fire targets into laser operated marksmanship training systems, thereby eliminating the cost of consumable ammunition and target repairs, reducing live fire hazards, and also reducing the land requirements for the ranges, while at the same time preserving the realism of targets that drop when struck.

DESCRIPTION OF THE PREFERRED EMBODIMENT

Figure 1:
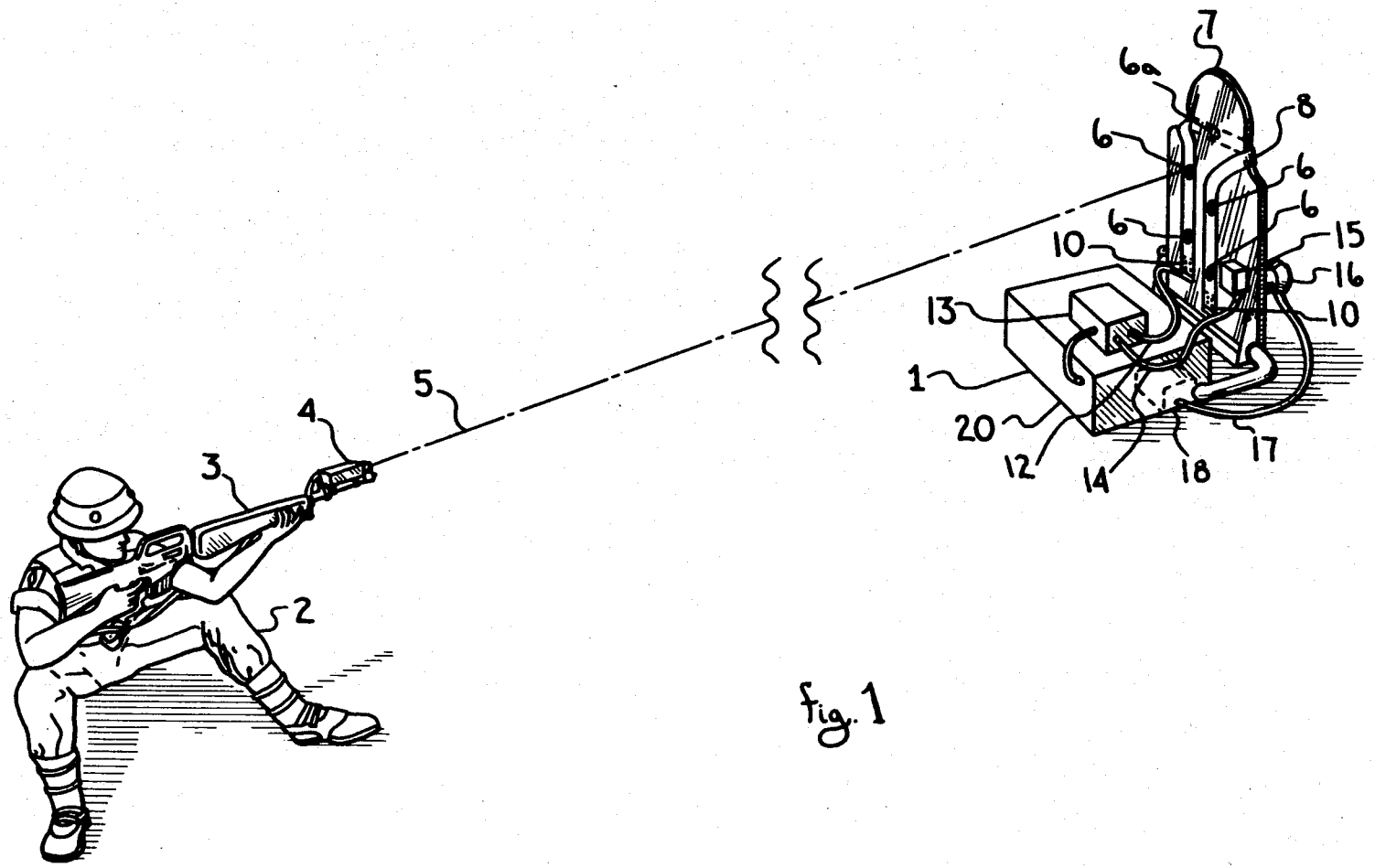
FIG. 1 is a perspective view of the target system according to the invention.

In FIG. 1 a target system 1 is shown in use in a typical range situation being fired at by a trainee 2 with a weapon 3 supporting and sighting a laser 4 producing a pulse coded beam 5, striking one or more photodetectors 6. The photodetectors 6 are arranged on a target 7, supported and electrically connected by a flexible harness 8 which is attached to target 7 by a separable adhesive means 10, such as hook-and-loop fabric. Although a man target is illustrated, the flexible harness may be attached in various arrangements on vehicle targets. On small targets, such as the man target 7 shown, one or more photodetectors 6a may optionally be on the back side of the target. The photodetector harness 8 is electrically connected by a cable 12 to an amplifier 13 with its output connected through cable 14 to a frequency selective vibration driving transducer 15 which is coupled acoustically to target 7. Also coupled acoustically to target 7 is a frequency selective vibration sensor transducer 16 which is electrically connected by cable 17 to an amplifier 18 within a target lift mechanism 20.

Figure 2:
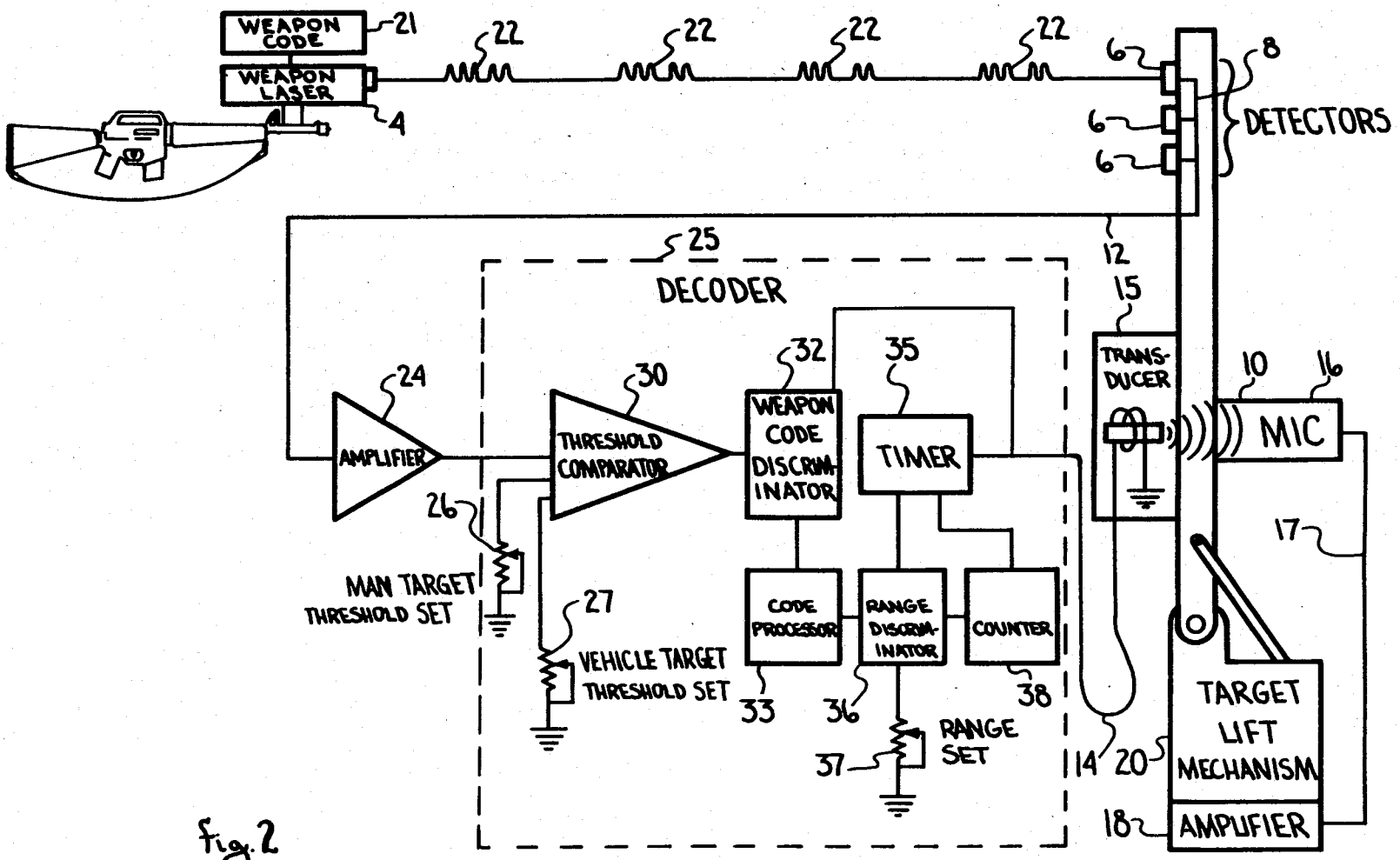
FIG. 2 is a schematic block diagram of the target system shown in FIG. 1.

In FIG. 2 the target system 1 of FIG. 1 is shown in which the laser 4 on weapon 3 is driven by a weapon code generator 21, producing one or more coded optical pulses 22 in laser beam 5. Coded pulses 22 are received by a photodetectors 6 and are transitted by cable 12 to an amplifier 24 within a decoder 25. Amplified pulse code signals are compared to a first higher threshold for a man target hit indication, set by a man target hit threshold adjuster 26, and a second lower threshold for a vehicle target hit indication, set by a vehicle target hit threshhold adjuster 27, and are compared to the amplified detector pulses by the threshold comparator 30.

Pulse signals above the threshold levels are processed by a weapons code discriminator 32 which compares them to a code format from a code processor 33, evaluating the relative lethality of the weapon against the applicable target type. Pulse signals found to meet threshold requirements and lethality requirements are fed into a timer 35 to evaluate pulse threshold level for firing range distance by a range discriminator 36, adjusted for range by range adjuster 37. Pulses are further evaluated by the timer 35 against the word counter 38, which establishes the number of serial pulses required for weapon types that require tracking the target over a period of time to make an effective hit.

Fully qualified pulses are transmitted by timer 35, through flexible cable 14 to a frequency selective transducer 15, which may be an electrical solenoid. The frequency selective vibration driving transducer 15 produces a vibration signature 40 which the frequency selective vibration sensor transducer 16 identifies as a target hit, transmitting a hit signal through cable 17 to an amplifier 18, initiating operation of the target lift mechanism 20 to lower the target.

We claim:

1. A target system for laser marksmanship training, comprising:

a target responsive to a range of vibration, means for producing laser pulses for simulating a projectile fired from a weapon toward said target, one or more photodetectors mounted on said target and sensitive to one or more pulses a vibration driving transducer operated from the output of the photodetectors attached and acoustically coupled to the target and producing a vibration for actuating said target.

2. A target system according to claim 1 in which the vibration driving transducer is an electrically operated solenoid.

3. A target system according to claim 1 in which the laser pulse producing means includes means for encoding said pulses of the laser beam with code sequences identifying simulated weapon projectile types being fired, and further comprising a decoder, responsive to signals from said photodetector, for decoding said pulse code sequences, said vibration driving transducer being selectively excited in response to a set of pulse code sequences meeting certain preset conditions, said set of pulse code sequences constituting a message.

4. A target system according to claim 1 further comprising a multi-threshold level signal comparator in which signal levels exceeding different threshold levels are identified as different target hits of varying vulnerability, said vibration driving transducer being energized to transmit a vibration to actuate said target.

5. A target system according to claim 3 in which the pulses of the laser beam include a code sequence identification of the relative lethality of a weapon being fired and wherein the decoder only accepts a message indicating specific weapons having a lethality to which the target has programmed vulnerability.

6. A target system according to claim 5 in which the decoder includes logic circuits commanding the decoder to receive a series of messages over a predetermined interval of time representing a tracking time in order to identify the received messages as a hit on the target when said messages identify a weapon requiring tracking of the target.

7. A target system according to claim 1 in which the photodetectors are spaced along a flexible strip of material which is attachable to the target in a number of different configurations.

8. A target system according to claim 7 in which the flexible strip is folded over the edge of the target whereby one or more of the detectors face away from the line of fire.

9. A target system according to claim 1, in which the photodetectors are attached to the target by an adhesive means including a two-component hook-and-loop fastener.

10. A target system for laser marksmanship training, comprising:

a target responsive to a range of vibration, means for producing laser pulses for simulating a projectile fired from a weapon toward said target, one or more photodetectors mounted on said target, responsive to said laser pulses, for producing a pulse signal whose signal level corresponds to the portion of said photodetectors struck by said laser pulses, a vibration driving transducer responsive to said pulse signals for producing a vibration for actuating said target.

11. A target system according to claim 10 wherein said laser pulse producing means includes means for encoding said pulses of the laser beam with code sequences identifying simulated weapon projectile types being fired, and further comprising:

means, responsive to the pulse signal produced by said photodetectors, for decoding said pulse code sequences, said vibration driving transducer being selectively excited in response to the meeting of certain preset conditions by said decoded pulse code sequences.

12. A target system according to claim 11 wherein said preset conditions correspond to a set of particular code sequences and a predetermined number of sets of code sequences striking said photodetectors within a certain time interval.

13. A target system according to claim 10 further comprising means for determining whether said pulse signal levels meet preset photo detector signal threshold levels, said vibration driving transducer being excited to produce said vibration only if said pulse signal levels meet said preset threshold levels, said preset levels being indicative of target vulnerability.

14. A target system according to claim 13 further comprising lethality determination means for comparing a message consisting of a set of encoded threshold pulse signals, to a preestablished code matrix which determines the lethality of a weapon projectile type corresponding to a particular code sequence with respect to said target's preset vulnerability, said lethality determination means being operative on said vibration driving transducer.

15. A traget system according to claim 14 wherein said lethality determination means further includes means for counting messages over a period of time, said vibration driving transducer being selectively responsive to a predetermined rate of messages.

16. A target system according to claim 15 wherein said lethality determination means in response to a code sequence corresponding to a type weapon requiring tracking of a target actuates said vibration driving transducer based on a predetermined rate of messages over an interval of time representing a tracking time.

17. A target system according to claim 16 wherein said predetermined rate of messages is varied to represent simulated projectile ranges.

18. A target system according to claim 17 wherein said control means activates said vibration driving transducer based on a predetermined rate of threshold encoded pulse signals in response to a code sequence indicating a weapon projectile type requiring tracking.

19. A target system according to claim 17 wherein said control means activates said vibration driving transducer based on a predetermined rate of threshold encoded pulse signals corresponding to a projectile range.

20. A target system for laser markmanship training, comprising:

a target responsive to a range of vibration, means for producing laser pulses for simulating a projectile fired from a weapon toward said target, means for encoding said pulses with code sequences identifying simulated weapon projectile types being fired, one or more photodetectors mounted on said target, responsive to said laser pulses for producing a pulse signal whose signal level corresponds to the portion of said photodetectors struck by said laser pulses, means for selectively processing pulse signals that meet a predeterminable threshold signal level, a vibration driving transducer responsive to said processed threshold pulse signals for producing a vibration indicative of a weapon-fired projectile striking said target, control means, responsive to said processed threshold encoded pulse signals, for activating said vibration driving transducer in response to a predetermined combination of code sequences and threshold signal levels.

* * * * *